United States Patent [19]

Ball et al.

[11] 4,404,776

[45] Sep. 20, 1983

[54] HANGING COMPONENTS FOR SPACE DIVIDER SYSTEM

[75] Inventors: Douglas C. Ball, Ste-Anne-de-Bellevue; William S. Stumpf; Gary R. Ludwig, both of Kitchner, all of Canada

[73] Assignee: Hauserman Ltd., Waterloo, Canada

[21] Appl. No.: 226,755

[22] Filed: Jan. 21, 1981

[51] Int. Cl.[3] ..... B66B 9/00

[52] U.S. Cl. ..... 52/29; 52/36; 52/239; 52/486; 52/802; 312/246; 312/248; 211/86; 108/152

[58] Field of Search ..... 52/36, 29, 239, 802, 52/486; 312/246, 248; 211/86; 108/152, 143; 70/95, 100; 160/201; 292/196, 200

[56] References Cited

U.S. PATENT DOCUMENTS

| | | | |
|---|---|---|---|
| 1,387,454 | 8/1921 | Coleman | 248/225.2 |
| 1,917,980 | 7/1933 | Kelsey | 312/183 |
| 2,175,717 | 10/1939 | Kerr | 52/239 |
| 2,240,484 | 5/1941 | Anderson | 52/239 |
| 2,271,678 | 2/1942 | Burdick | 312/183 |
| 3,212,646 | 10/1965 | Propst | 52/36 |
| 3,593,470 | 7/1971 | Francis | 108/152 |
| 3,777,437 | 12/1973 | Christen | 52/239 |
| 3,886,698 | 6/1975 | Raith et al. | 211/87 |

FOREIGN PATENT DOCUMENTS

| | | | |
|---|---|---|---|
| 650810 | 10/1962 | Canada | 52/239 |
| 511143 | 10/1930 | Fed. Rep. of Germany | 52/802 |

*Primary Examiner*—John E. Murtagh
*Assistant Examiner*—Mark J. Sofia
*Attorney, Agent, or Firm*—Maky, Renner, Otto & Boisselle

[57] ABSTRACT

Hanging components of the enclosed or open shelf type for an interior space dividing system utilize a disappearing pivoting hook at the upper rear corners and a pivoting mounting bracket or foot at the lower rear corners, the latter being pivoted to two alternative positions depending on the supporting horizontal frame element of the system or elevation at which the component is supported. Such hooks and mounting brackets are for the most part enclosed within the back-to-back face plates of the vertical panels of the components, such panel forming face plates having rounded edges forming a peripheral slot, such slot being enlarged to accommodate the pivoting movement of the disappearing hook and mounting foot. The face plates are readily assembled and disassembled by an internal tongue and slot connection at the front and by fasteners at the rear which extend through collars forming the pivots for the hook and bracket. Each unit includes a bottom shelf and rear wall provided with edge slots to accommodate a disappearing lock hook for the tambour door of the enclosed unit or for inclined or vertical dividers for either unit, respectively.

26 Claims, 5 Drawing Figures

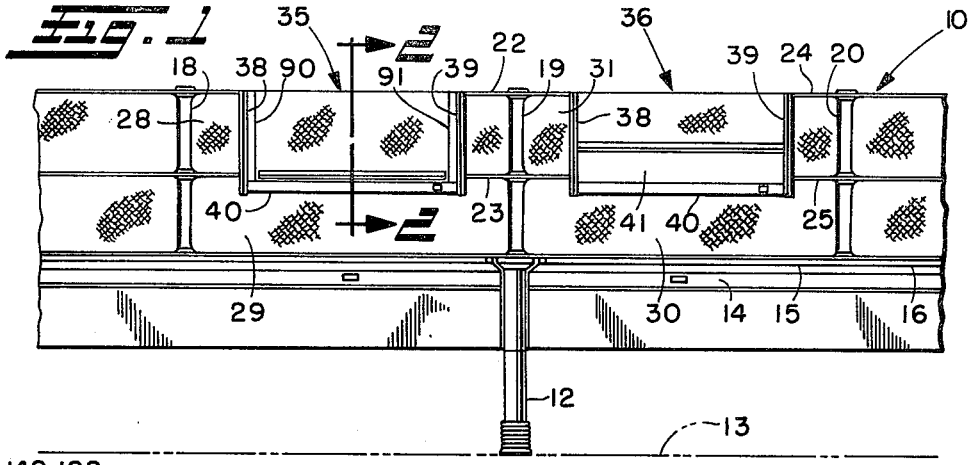
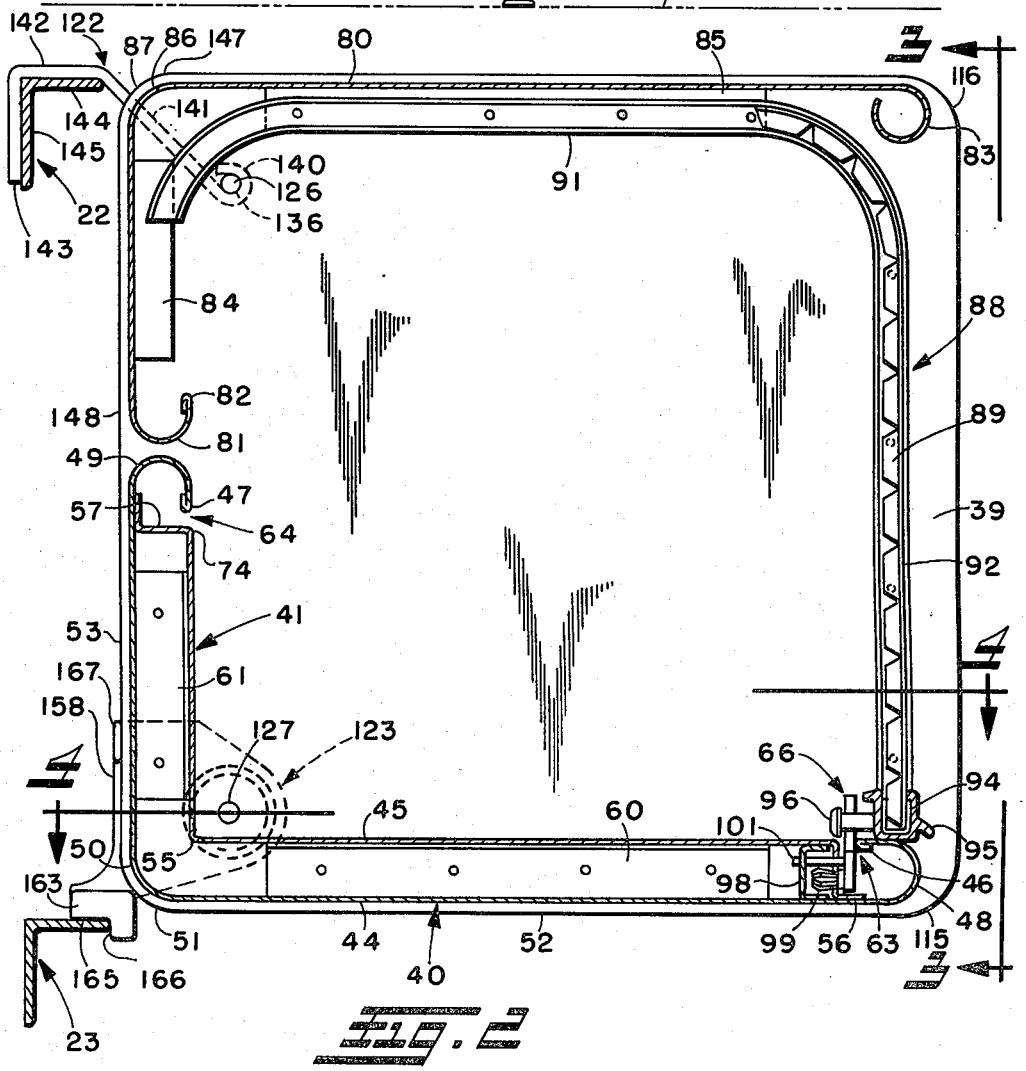
Fig. 2

HANGING COMPONENTS FOR SPACE DIVIDER SYSTEM

This invention relates generally as indicated to hanging components for an interior space dividing system, and more particularly to a storage component which may be hung above or hung or supported at work surface height in an interior space dividing system such as shown in copending application of Douglas C. Ball et al, Ser. No. 081,437, filed Oct. 3, 1979.

BACKGROUND OF THE INVENTION

Storage components which may be hung from slotted edges of interior panels or intermediately from load bars are shown for example, in Raith et al, U.S. Pat. No. 3,886,698.

Such prior art storage components are limited in their application, relatively heavy, complex of construction and fairly costly. They generally require fixed hook and abutment brackets which require tools to assemble and disassemble. Moreover, the component parts are not readily assembled, disassembled or interchangeable with storage units having other functions or hanging or support locations.

Many such prior art storage components having walls or shelves formed of pressed wood or fiber laminated with a suitable covering. The supporting hardware is usually firmly affixed to the back of such components and limits such components in their position and application.

It is difficult to fabricate hanging components of the proper appearance of easily fabricated metal parts because of tolerance problems in manufacture and assembly. This is particularly true of space plate formed walls or panels having edge contact.

SUMMARY OF THE INVENTION

It has been found that the vertical walls or panels of such units can be formed with plates having rounded edges slightly gap spaced which not only enhances the appearance of the walls but also reduces their weight and cost. It has also been found that such spaced plate wall construction of the hanging components facilitates the employment of hooks or support brackets or feet which are or can be for the most part concealed.

Further, such spaced plate construction of the vertical walls can be highly similified utilizing a tongue and slot connection in stiffening plates or flanges provided along the interior front edge of the walls and utilizing two vertically spaced fasteners along the rear edge of the walls, which fasteners are secured in internal collars which also serve as pivots for the hooks or support brackets or feet which are for the most part concealed between the wall plates.

With such construction the hanging hooks at the upper rear corners of the walls may be pivoted to a position wherein they are completely enclosed between the spaced plates or to a position where they may engage and support the component from one of the structural rails at substantially any point therealong such as shown in the aforementioned Ball et al application, Ser. No. 081,437. Also, the mounting feet or brackets at the lower rear corners of such vertical walls may be pivoted to alternative positions enabling the components to be supported on rails identical to that supporting the hooks or on a wiring conduit of specialized construction at essentially work surface height. The components may also be supported free standing on work surface supported at least partially by the structural spine or beam of the interior space dividing system shown in the noted application, Ser. No. 081,437. Such system is the award winning system marketed by the SUNAR Division of Hauserman Ltd. under the trademark RACE.

The components may be of the open shelf type or the enclosed type. Each unit includes a bottom shelf and a rear wall which extends for approximately one-half the height of the unit. Both the bottom shelf and rear wall are provided with rounded edges and adjacent internally facing edge slots. The edge slot on the rear wall is employed to accomodate either inclined or vertical compartment dividers or the like. The front edge slot in the enclosed unit accomodates a disappearing locking hook for the tambour door of the enclosed unit.

The enclosed unit, in addition to the shelf, is provided with a top cover in and tracks on the interior of the vertical walls for the tambour door. The disappearing hook may be operated by a horizontally extending slide bar from a key operated tumbler accessible through the front edge of the shelf. The tambour door may be provided with a fabric cover to enhance the appearance of the unit.

Whether the component is an open shelf unit or the tambour door enclosed unit, most of the components are the same.

It is accordingly a principle object of the present invention to provide a hanging component for an interior space divider system of the type shown in the copending application of Douglas C. Ball et al, Ser. No. 081,437.

A further principle object is the provision of such hanging component utilizing parallel vertical walls in which are secured hooks or support brackets or feet which are or can be for the most part concealed.

Another important object is the provision of such hanging components utilizing vertical walls of simplified plate construction which may readily be assembled and disassembled.

Still another important object is the provision of such hanging components wherein the walls are formed of spaced plates having rounded edges. It is also such object wherein the edges of the spaced plates are slightly gap spaced.

Yet another object is the provision of such hanging component wherein the walls are of the noted space plate construction which may be assembled along the front thereof by a tongue and slot connection and along the rear thereof by a fastener-pivot connection, the pivots forming pivots for the hanging elements of the component.

It is also an object of the present invention wherein the components may be supported at different elevations from different horizontal structural elements of the system as desired.

A further object is the provision of such hanging component which may either be of the open shelf type or enclosed with a tambour door.

A still further object is the provision of such units that utilize many light weight easily manufactured metal components.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 1 is a fragmentary front elevation of a space divider system illustrating hanging components of the present invention thereon;

FIG. 2 is an enlarged vertical section taken through an enclosed hanging component as seen from the line 2—2 of FIG. 1;

DETAILED DESCRIPTION OF THE PREFERRED EMBODIMENTS

Figure 3:
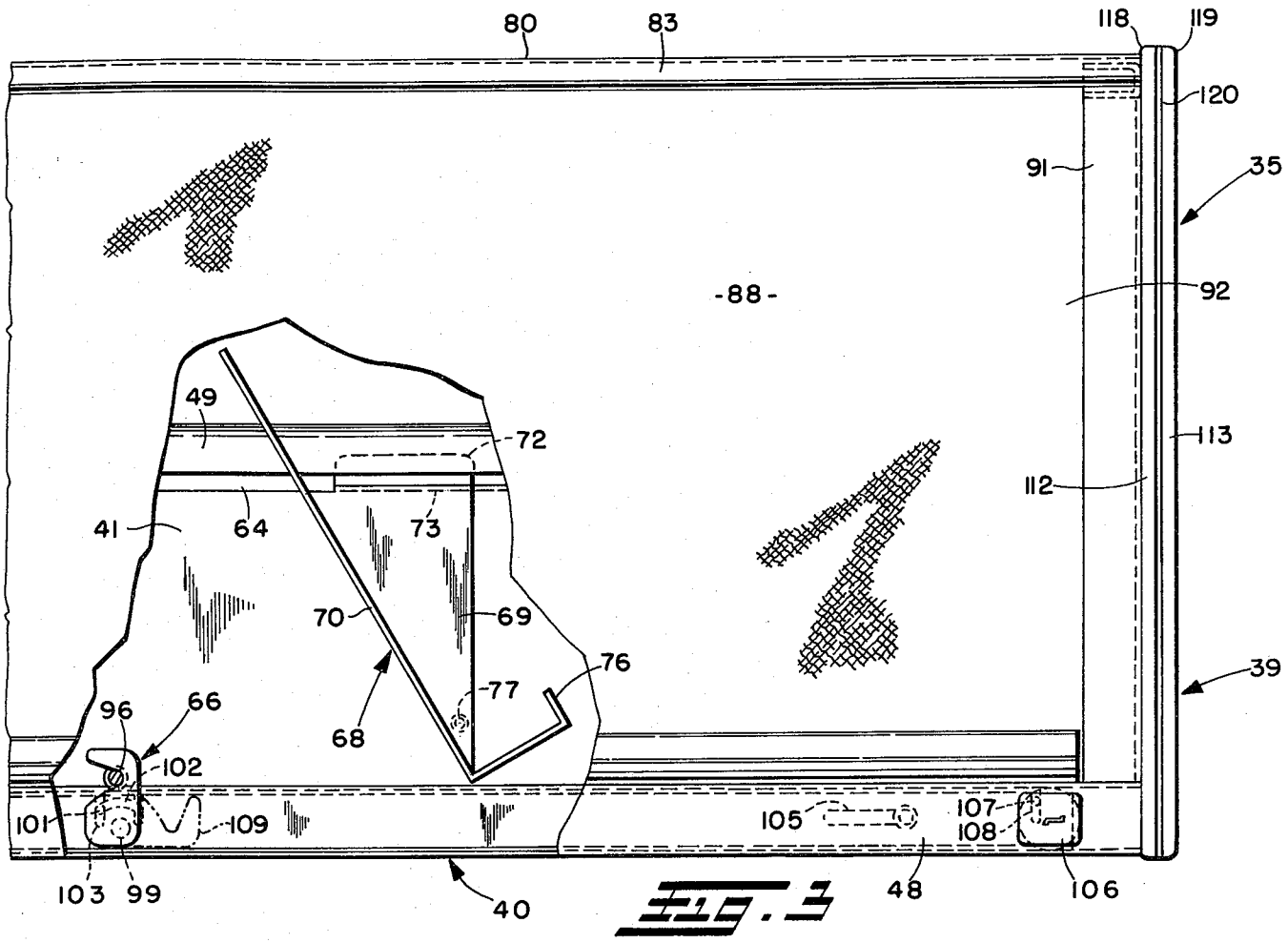
FIG. 3 is a fragmentary front elevation of the component of FIG. 2 with the front partially broken away and illustrating an inclined divider therein.

Referring now to the annexed drawings and more particularly to FIG. 1, there is illustrated an interior space dividing system shown generally at 10, such system being of the type shown in the copending application of Douglas C. Ball et al, Ser. No. 081,437, filed Oct. 3, 1979. Such system shown generally at 10 comprises horizontal beams or structural spines 11 which are supported between posts or legs 12 above the floor 13. On top of the beams or structural spines 11 there is mounted electrical raceways 14 and above such raceways 14 there is mounted a communications wiring duct 15. Such wiring duct is laterally enlarged and provided with rounded lateral edges 16 seen more clearly in FIG. 5, all as shown in the aforementioned Ball et al application, Ser. No. 081,437. The electrical and communications ducts supported on the beam 11 are at substantially work surface height.

Extending above the electrical and communication ducts are posts seen at 18, 19 and 20 in FIG. 1. Extending horizontally between such posts are vertically spaced rails seen at 22 and 23, between the posts 18 and 19, and 24 and 25 between the posts 19 and 20. Such rails are of the back-to-back angle configuration shown more clearly in such prior application Ser. No. 081,437 and the frames formed thereby may be closed by acoustical pads of the type seen in the copending application of William Stumpf and Gary Ludwig, Ser. No. 224,892 filed Jan. 14, 1981. Such pads are shown at 28, 29, 30 and 31, for example. The pads serve as an acoustical barrier between work stations on opposite sides of the divider system and also for acoustical absorption of ambient noise in the interior open office.

As seen in FIG. 1 at 35 and 36, hanging storage components in accordance with the present invention may be supported between the horizontal rails 22 and 23, and 24 and 25, respectively. Components 35 and 36 are of the enclosed and open type, respectively.

As will more fully be described such components have common vertical walls seen at 38 and 39 interconnected by a bottom shelf 40 which also includes an upstanding rear wall 41 extending approximately half the height of the unit.

As seen more clearly in FIG. 2, the shelf 40 has an outer metallic skin 44 and an inner spaced metallic skin 45. The front and top edges of the outer skin are flat folded as seen at 46 and 47 and then are provided with a circular or rounded end seen at 48 and 49, respectively. The outer rear corner of the shelf unit is provided with a quadrant shape circular bend 50 having the same center at the circularized lower rear corner 51 of the vertical walls 38 and 39. The bottom skin is slightly spaced inwardly from a bottom edge 52 and rear edge 53 of such walls.

The inner skin 45 is corner folded as seen at 55 and the front and top edges are provided with L-shape flanges seen at 56 and 57 with the shorter leg parallel to the faces of and flush against the inside surface of the outer skin. The lateral edges of the inner and outer skins are provided with overlapping edge flanges indicated at 60 and 61 which are tack welded to each other and to the insides of the vertical walls 38 and 39.

The illustrated construction of the bottom shelf unit provides an inwardly opening slot 63 along the front edge and also an inwardly opening slot 64 along the top edge. The bottom slot 63 accomodates one or more locking hooks 66 for the enclosed unit while the top slot 64 may accomodate one or more vertical inclined dividers 68 seen more clearly in FIG. 3.

Such dividers have a vertical wall 69 and a dividing wall 70 normal thereto. The upper edge of the vertical wall 69 is provided with a slightly rearwardly offset upwardly directed flange 72, the offset 73 forming a relatively narrow horizontal shelf. In this manner, the upwardly directed offset flange 72 can readily be inserted in the slot 64 with the shelf 73 supported on the edge of the slot as seen at 74 in FIG. 2. The upwardly extending flange 72 will lie against the inside of the flat folded edge 47. The bottom edge of the dividing wall 70 is provided with an L-shaped flange 76 to support the lower edge of files or papers and the like extending toward the viewer as seen in FIG. 3. The vertical wall may be provided with a bearing dimple 77 to maintain the vertical wall at its lower end slightly spaced from the inner skin of the upwardly extending portion 41 of the shelf. It will be appreciated that the divider walls 70 may be vertical or that other forms of supports or dividers may equally well be supported in a similar manner from the slot 64.

For the enclosed unit 35 only, the top cover or skin 80 is provided which has a rear edge rounded at 81 and provided with a flat edge fold seen at 82. The front edge is provided with a circular almost closed stiffening tube edge 83. Inwardly directed edge flanges 84 and 85 are employed to secure the cover to the interiors of the vertical walls 38 and 39, slightly spaced from the edges thereof as seen. The upper rear corner of the cover is rounded at 86 on the same center as the upper rounded rear corners 87 of the walls.

For such enclosed unit 35 there is also provided a tambour door shown generally at 88. The door unit 88 includes the flexibly interconnected transverse slats 89 which ride in channel shape tracks or slots 90 and 91. The exterior of the slats may be suitably covered by a fabric 92 to provide the desired appearance compatible with the fabric of the acoustical pads of the system seen in FIG. 1.

The lower edge of the door is provided with a reinforcing channel 94 extending transversely thereof as well as a somewhat heavier handle or grasp 95 which includes a rearwardly projecting headed locking pin 96. As seen more clearly in FIGS. 2 and 3, the pin 96 is designed to mate with the interior of hook 66 when the door is down and the hook is pivoted to its up position.

Pivoting of the hook is obtained by horizontal movement of channel-shape slide bar 98 which is mounted behind the L-shaped flange 56. The hook includes a snap-in pivot 99 which projects through a hole in the vertical wall of the L-shaped flange 56. The hook also includes a pin 101 which projects through an arcuate slot 102 in the vertical wall of the flange 56 and a vertical slot 103 in the slide bar 98. A headed pin and slot connection seen generally at 105 maintains the slide bar against movement except normal to the plane of FIG. 2 or in the plane of FIG. 3.

Movement of the slide bar is obtained by the tumbler of key lock mechanism 106. The tumbler includes a projecting pin 106 similar to the pin 101 which extends into a vertical slot 108 in the slide bar. Thus, when a key is inserted in the lock and the tumbler rotates it will move the slide bar horizontally. In the position shown the pin 107 has been moved to the left as seen in FIG. 3 which moves the slot 103 to the left causing the pin 101 to move through the arcutate slot 102 pivoting the hook 66 from the retracted or down position seen at 109 in phantom lines to the up or full line position shown. In this manner when the door 88 is pulled down to the closed position it can be key locked in such position. It can also be key unlocked. In any event, when the door is unlocked, the door can be slid upwardly so that the tambour slats and the fabric covering move along the tracks 90 and 91.

It will be appreciated that for the open unit 36, the top cover 80, the door and tracks, as well as the locking mechanism may be omitted. Otherwise, the units are the same.

Figure 4:
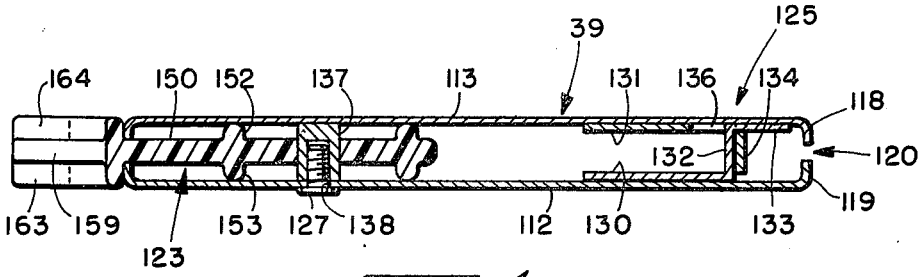
FIG. 4 is an enlarged full size broken horizontal section through a vertical wall or panel of the component as taken substantially on the line 4—4 of FIG. 2.

As seen more clearly in FIGS. 3 and 4, the vertical walls or panels are formed of spaced inner and outer plates or skins seen at 112 and 113, respectively. Each of the plates is provided with rounded corners, the rear as seen at 51 and 87 and also at the front as seen at 115 and 116. Such plates around the entire periphery are inwardly rounded as seen at 118 and 119, such plate edges terminating in a slight gap spacing 120 which extends completely around the edge of each end panel. The gap 120 may be completely around the edge of each end panel. The gap 120 may be slightly enlarged at the upper and lower rear corners to accomodate hook 122 and mounting foot or bracket 123, respectively.

The plates 112 and 113 are held together at the front by a tongue and slot connection shown generally at 125, and at the rear by two vertically spaced fasteners seen at 126 and 127. The tongue and slot connection is formed from stiffening plates 130 and 131 secured to the interior of the inner and outer plates, respectively. The plate 130 includes at least two vertically spaced L-shaped flanges 132 which terminate in tongues or plates 133 parallel to but spaced from the inner plate 112. The stiffening plate 131 is provided with a normal stiffening flange 134 which may extend the full height thereof but which is provided with slots 136 which extend through the root portion of the flange 134 the thickness of the tongue 133. In this manner the plates may be assembled along the front edge by simply inserting the tongues 133 into the slots 136.

Each of the outer plates at the upper and rear corners is provided with an internally threaded inwardly projecting collar as seen at 136 and 137. The internally threaded bores in such collars in the assembled position are aligned with holes in the inner plates such as shown at 138 in FIG. 4 through which the fasteners may be inserted and threaded into the collars. The blind ends of the collars may be secured by track welding to the interior of the outer plates. The collars also serve as supports and pivots for the hooks 122 and the mounting feet 123.

Each hook 122 includes a circularized proximal portion 140 extending about the collar 136 and a straight portion 141 extending through the somewhat enlarged gap at the corner 87 between the rounded internally directed plate edges. The hook then terminates first in a horizontal portion 142 and then in vertical distal portion 143. In this manner the hook is designed to fit over the upper leg 144 of the angle 22 with the distal portion 143 fitting between the vertical legs of the back-to-back angles which form the rail 22. For a more detailed disclosure of such rail reference may be had to the aforementioned copending application of Douglas C. Ball et al, Serial No. 081,437.

The enlarged gap in the gap edge of the vertical wall or panel may extend from approximately the point 147 to the point 148 seen in FIG. 2 to permit the hook 122 to pivot to a completely enclosed position when not in use or when the hanging unit is being transferred to another location.

Figure 5:
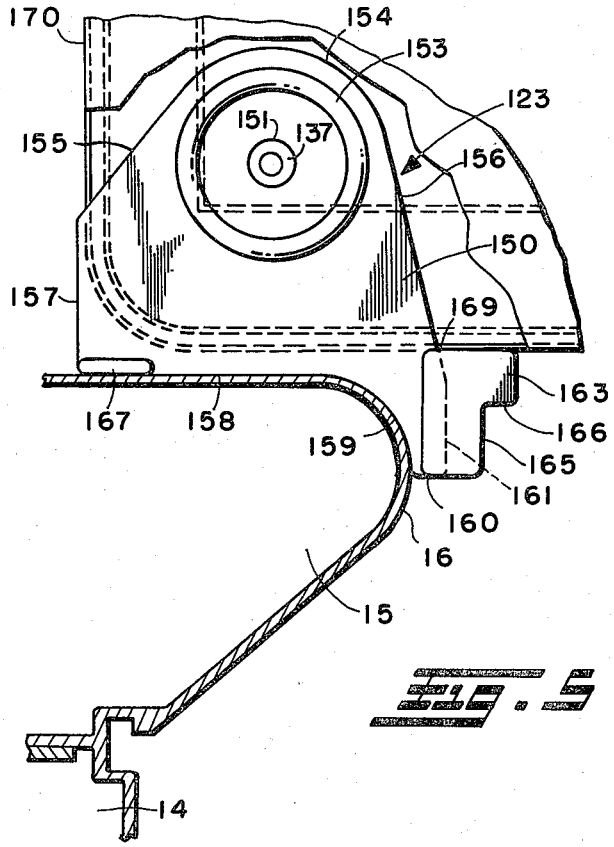
FIG. 5 is a fragmentary broken vertical section through the pivotally mounted bracket at the rear bottom corner of the vertical wall showing the bracket in an alternative position to support the component on the top of the wiring duct of the system which is at substantially work surface height.

Now referring more particularly to FIGS. 2, 4 and 5, it will be seen that the lower corner mounting bracket in each wall may be a molded plastic element having a vertical relatively narrow plate 150 provided with a hole 151 through which the collar 137 extends. Two annular beads 152 and 153 project on opposite sides of the plate concentric with the hole 151 and act as bearing surfaces against the interior of the plates 112 and 113.

As seen more clearly in FIG. 5, the plate 150 includes a circular edge 154 concentric with the hole 151 and tangent edges 155 and 156. The tangent edge 155 terminates in an obtuse angle with edge 157 which terminates in a right angle rounded corner with edge 158. The edge 158 is tangent to a curved portion 159 which terminates with a rounded corner with relatively short edge 160. The edge 160 joins edge 161 at a right angle corner which joins the edge 156 with an obtuse angle.

Parallel but offset ears are formed intergrally with the plate 150 as seen at the 163 and 164, each of which is provided with a cut-away corner forming a supporting edge 165 and a shoulder 166. Adjacent the corner between the edges 157 and 158 there is provided a lateral enlargement for the plate 150 seen at 167 which serves as a stabilizing foot for the edge 158 in the position shown in FIG. 5 and as an abutment stop in the position shown in FIG. 2.

An enlarged gap between the edges of the plates 112 and 113 forming the end walls or panels may extend from approximately the point 169 in FIG. 5 to the point 170. This permits the bracket or foot 123 to pivot approximately 90 degrees from the position shown in FIG. 2 to the position show in FIG. 5 and vice versa. In the position of FIG. 2, the corner cutout of the ears supports the hanging unit at the bottom rear corner on the edge of the upper leg 144 of the angle of the frame 23. However, with the feet pivoted 90 degrees as in FIG. 5, the hanging unit may be supported at its upper edges along the rail 23 and at its lower edges on the laterally enlarged communication wiring duct 15 which has the rounded edges 16. It will also be appreciated that the hanging units may be supported directly on a planar surface by the lower edges of the two vertically spaced walls or panels with the ears projecting behind the rear edge of the work surface when in the position seen in FIG. 2. Alternatively, the mounting brackets 123 may be removed.

It will be apparent that with the hooks and feet pivoted within the mid-plane of the vertical panels, the units may be cantilevered from the system at any available point creating torsional loads on the vertical panels and shelf forming the main frame of the units.

It can now also be seen that there is provided hanging storage components of the enclosed or open shelf type for an interior space dividing system utilizing a disappearing pivoting hook at the upper rear corners and a pivoting mounting bracket or foot at the lower rear corners of the vertical panels or walls. The two positions of the mounting bracket enable the component to be supported at two different elevations in the system. Such hooks and mounting brackets are for the most part enclosed within back-to-back face plates of the vertical panels of the components, such panel forming face plates having rounded edges forming a narrow peripheral slot or gap such gap being enlarged to accomodate the pivoting movement of the disappearing hook and mounting foot. The plates are readily assembled and disassembled by an internal tongue and slot connection at the front and by fasteners at the rear which extend through collars forming the pivots for the hook and foot or bracket. Each unit includes a bottom shelf and rear wall provided with edge slots to accomodate a disappearing locking hook for the enclosed unit or for inclined or vertical dividers or the like for either unit, respectively.

We claim:

1. A hanging component for an interior space dividing system comprising horizontally spaced vertical panels, each panel being formed of spaced plates, means within said panels at the upper and lower rear corners for hanging said component on such space dividing system, and supports for said means within said plates, said supports being pivot collars fixed to the interior of one plate and secured by fasteners to the other and also serving to secure said plates together.

2. A component as set forth in claim 1 wherein each plate is provided with rounded inwardly turned edges which are slightly gap spaced from each other.

3. A component as set forth in claim 2 wherein such gap spacing is slightly enlarged at the upper and lower rear corners to accomodate said means.

4. A component as set forth in claim 1 including a peripheral edge gap separating the edge of said spaced plates, said edge gap being slightly enlarged in the area of said pivot collars to accomodate said means for pivotal movement.

5. A component as set forth in claim 1 including a horizontal shelf interconnecting said panels at the lower edge thereof.

6. A component as set forth in claim 5 including an interior slot in said shelf at the front edge thereof, and a door for said unit, and a locking hook for said door mounted in said interior slot.

7. A component as set forth in claim 6 including a locking slide bar mounted in said shelf operative to pivot said locking hook from a position recessed within said slot to an operative position.

8. A component as set forth in claim 7 wherein said door is a sliding tambour door.

9. A component as set forth in claim 8 including a cover enclosing said unit.

10. A hanging component for an interior space dividing system comprising horizontally spaced vertical panels, each panel being formed of spaced plates, and means within said panels at the upper and lower rear corners for hanging said component on such space dividing system, said means including at the lower corner a pivotally mounted foot.

11. A hanging component for an interior space dividing system comprising horizontally spaced vertical panels, each panel being formed of spaced plates, and means within said panels at the upper and lower rear corners for hanging said component on such space dividing system, said means being pivoted on respective collars also employed to secure the plates of each panel together.

12. A hanging component for an interior space dividing system comprising horizontally spaced vertical panels, each panel being formed of spaced plates, and means within said panels at the upper and lower rear corners for hanging said component on such space dividing system wherein said means are each movable between first and second positions and wherein one of said means in one of said positions is completely enclosed between said plates.

13. A component as set forth in claim 12 wherein said one of said means is movable between a first position in which said one of said means is completely enclosed between said plates and a second position in which a portion of said one of said means extends outward from said plates to engage a portion of said interior space dividing system.

14. A hanging component for an interior space dividing system comprising horizontally spaced vertical panels, each panel being formed of spaced plates, means within said panels at the upper and lower rear corners for hanging said component on such space dividing system, and spacer means to hold said plates in spaced relation to define a gap space between the edges thereof, said spacer means comprising a first stiffener bracket connected with one plate and having a portion normal to the plane of said one plate and apertures formed in said normal portion, and a second stiffener bracket connected with another of said plates and having tongues which extend parallel to and spaced from the plane of said other plate, said tongues being received in said apertures to maintain said first and second plates in spaced relation.

15. A hanging storage component adapted to be supported at different elevations or horizontal locations on an interior space divider system, and a movable support at the lower rear corner of said component operative when moved to present support surfaces of different configuration corresponding to support surfaces of such different configuration on such interior space divider system, said movable support pivoting approximately 90° between stops to present such different configuration support surfaces.

16. A hanging storage component adapted to be supported at different elevations or horizontal locations on an interior space divider system, and a pivotable support at the lower rear corner of said component operative when moved to present support surfaces of different configuration corresponding to support surfaces of such different configuration on such interior space divider system, said component including horizontally spaced vertical walls, each wall comprising spaced plates, said pivotable support being pivoted on a collar extending between said plates and being substantially concealed within vertical walls of said component.

17. A component as set forth in claim 16 wherein said collar also is employed to secure said plates together.

18. In combination, an interior space dividing system adapted to support storage components at different elevations and horizontal locations on support surfaces of different configuration, and a hanging storage component including a pivotable support operative when moved to present support surfaces of different configuration corresponding to said support surfaces of different configuration on said interior space divider system, said pivotable support pivoting approximately 90° between stops to present such different configuration support surfaces.

19. In combination, an interior space dividing system adapted to support storage components at different elevations and horizontal locations on support surfaces of different configuration, and a hanging storage component including a pivotable support operative when moved to present support surfaces of different configuration corresponding to said support surfaces of different configuration on said interior space divider system, said component including horizontally spaced vertical walls, each wall comprising spaced plates, said movable support being pivoted on a collar extending between said plates and being substantially concealed in vertical walls of said component.

20. The combination set forth in claim 19 wherein said collar also is employed to secure said plates together.

21. A hanging component for an interior space dividing system comprising horizontally spaced vertical panels, each panel being formed of spaced plates, each plate being provided with rounded inwardly turned edges which are slightly gap spaced from each other, support means for said component at the upper and lower rear corners of said panels substantially concealed between said plates, said support means being mounted on pivots, said pivots also being employed to secure said plates together, and such gap spacing between said plates is slightly enlarged at such upper and lower rear corners to accommodate said support means for movement.

22. A hanging component for an interior space dividing system comprising horizontally spaced vertical panels, each panel being formed of spaced plates, each plate being provided with rounded inwardly turned edges which are slightly gap spaced from each other, fasteners at the upper and lower rear corners securing said plates together, and support means for said component pivoted on said fasteners.

23. A hanging component for an interior space dividing system comprising horizontally spaced vertical walls, each wall comprising interconnected plates and pivot means interconnecting said plates at the rear thereof, said pivot means mounting means to said walls for mounting and supporting the component on said system.

24. A component as set forth in claim 23 including alternative positions for at least one of said mounting means to support the component at a different elevation on such system.

25. A hanging component for an interior space dividing system comprising horizontally spaced vertical panels, each panel being formed of spaced plates, means within said panels at the upper and lower rear corners for hanging said component on such space dividing system, and supports for said means within said plates, said supports also serving to secure said plates together.

26. A hanging component for an interior space dividing system comprising horizontally spaced vertical panels, each panel being formed of spaced plates, means within said panels at the upper and lower rear corners for hanging said component on such space dividing system, an upwardly extending rear wall interconnecting said panels and having an inwardly directed slot along its top, said slot being at least partially defined by generally vertical interior and exterior surfaces above and below said slot, a component divider with an article supporting surface, and stabilizing means for maintaining said article supporting surface normal to said rear wall, said stabilizing means including a vertical wall connected with said article supporting surface, an upwardly directed flange connected with, parallel to, and rearwardly offset from said vertical wall, said vertical wall engaging a portion of said exterior slot-defining vertical surface and said flange engaging a portion of said interior slot-defining vertical surface.

* * * * *